US006646190B2

(12) United States Patent
Brown

(10) Patent No.: US 6,646,190 B2
(45) Date of Patent: Nov. 11, 2003

(54) ACOUSTIC STRINGED INSTRUMENT WITH SPRING SUPPORTED TOP

(76) Inventor: Kevin Brown, 84 Henry St. #2a, Cambridge, MA (US) 02139

( * ) Notice: Subject to any disclaimer, the term of this patent is extended or adjusted under 35 U.S.C. 154(b) by 0 days.

(21) Appl. No.: 10/039,256

(22) Filed: Jan. 1, 2002

(65) Prior Publication Data

US 2003/0121393 A1 Jul. 3, 2003

(51) Int. Cl.[7] ..... G10D 3/00

(52) U.S. Cl. ..... 84/291; 84/290

(58) Field of Search ..... 84/290, 291, 292, 84/267, 275

(56) References Cited

U.S. PATENT DOCUMENTS 6,188,005 B1 * 2/2001 White ..... 84/267
6,233,825 B1 * 5/2001 DeGroot ..... 29/896.22
6,333,454 B1 * 12/2001 Griffiths ..... 84/290

* cited by examiner

*Primary Examiner*—Kim Lockett

(57) ABSTRACT

A stringed instrument with a compliantly suspended sound board allows for deeper, richer sound in s smaller sized instrument. The compliant suspension of the sound board allows for greater acoustic excursions at the edges of the sound board. The resonance set up between the compliance of the sound suspension and the mass of the sound board may be placed below and near the Helmholtz resonance of the instrument to effectively create a broader, lower-frequency Helmholtz resonance than would typically be achievable in instruments of similar size.

11 Claims, 4 Drawing Sheets

ACOUSTIC STRINGED INSTRUMENT WITH SPRING SUPPORTED TOP

BACKGROUND

Stringed instruments have been around for over 1000 years. The earliest stringed instruments seem to have developed from tightly strung bows that were used as weapons. Modern acoustic stringed instruments all take mechanical vibrational energy originating in the plucking, strumming, hammering, or bowing of strings, and couple that vibrational energy to the surrounding air. Typically, an acoustic sound board and acoustic resonant cavities are employed to both shape the amplitude-frequency spectrum of the energy coupled from the strings to the air, and to serve as an impedance matching mechanism to efficiently transfer a larger percentage of the vibrational energy of the strings to the air.

Typically, larger sound boards and larger acoustic resonant cavities must be employed to efficiently couple lower frequency vibrational energy from strings into the surrounding air. The familiar piano and double bass play the lowest notes of any stringed instruments in a typical symphony, and their familiar large size stems from the need to efficiently couple the energy of low-frequency string vibrations to the surrounding air.

It is an object of the present invention to provide acoustic stringed instruments of reduced size, which provide improved low-frequency of string vibration to the air, thus providing deeper, louder, richer sound in a compact instrument.

FIG. 1 shows a cutaway drawing of a typical modern acoustic guitar.

When the strings are plucked or strummed, their vibration is transferred to the top of the guitar (also referred to as the sound board) through the bridge. The strings act as mechanical traveling-wave resonators. FIG. 2 depicts sequential 'snapshots' of the oscillation of a string after it is plucked.

In snapshot 'a' in FIG. 2, the string is stretched taught with its center displaced by the plucking or strumming object (finger, pick, etc.). In snapshots 'b,' through 'f' the string vibrates to its opposite phase. Snapshots 'h' through 'l' show the return phase of the oscillation. The sequence then repeats. FIG. 2 shows the oscillation of one standing wave section (half-wavelength) of a vibrating string. Any number of half-wavelength standing wave sections may exist on a vibrating string, allowing one vibrating string to contain vibrational energy at a fundamental and all of its harmonics. Different harmonics on a vibrating string are depicted in FIG. 3.

Vibrational energy from the strings couple to vibrational modes on the sound board, and to Helmholtz resonator vibrational modes of the partially enclosed air volume of the body of the guitar.

FIG. 4 shows Chlandi patterns indicating the resonant modes of the top (sound board) of a guitar at various frequencies. These resonant modes are excited through the bridge of the guitar by the vibration of the strings. Since the sound board has a bigger surface area than the strings, in more effectively couples sound to the air. The sound board acts as a coupled resonator (coupled to the strings through the bridge), and an impedance matching system to efficiently transfer vibrational energy from the strings to the air.

The lowest resonant mode of the sound board on a guitar doesn't produce any Chlandi pattern, because the only node contour is the outer edge of the sound board itself. In this mode the top (sound board) of the guitar bows back and forth as depicted in cross-section in FIG. 5B. FIG. 5A shows how the sound board would bow back and forth if it were of uniform compliance (such as the membrane of a drum).

Because of the nature of how the edges of the sound board are fixed in a typical guitar, the attachment perimeter is typically more stiff than the middle of the sound board, resulting in the flattened edges of the excursions of the sound board in FIG. 5B as compared to FIG. 5A. The area between the dotted and solid lines in FIG. 5A and FIG. 5B can be thought of as representing the amount of air moved by the sound board resonance. More air moved (more area between the dotted and solid lines) represents a louder sound. In a typical sound board (represented in FIG. 5B), only the middle portion of the sound board has significant excursion in the lowest mode, thus even though a guitar might be "full sized", only a fraction of the area of its sound board is making most of the sound.

In addition to the lowest vibrational mode of the sound board, the acoustics of the guitar include another low-frequency coupled resonator which comes from the Helmholtz resonance of the partially enclosed air in the body of the guitar. The air in the body acts as a spring, and the air around the port acts as a mass. The elements of this resonator are depicted in FIG. 6.

All of the resonant modes of the sound board and the air in the guitar will be referred to in this patent application as Coupled Acoustic Resonances. The resonances of the strings themselves will be referred to as Driving Acoustic Resonances.

SUMMARY OF THE INVENTION

The present invention allows for a lowering of the two lowest coupled acoustic resonances of sound-board-equipped stringed instrument such as a guitar. Instead of attaching the sound board rigidly around its perimeter, the present invention provides for a sprung suspension around the perimeter of the sound board. The sprung suspension is acoustically sealed so that it does not act as an additional port. A cut-away diagram of a preferred embodiment of the improved guitar body including sprung suspension is shown in FIG. 7. The spring suspension comprises a wooden bellows-like structure connecting the side walls of the guitar body to the sound board.

This bellows-like suspension allows the entire sound board of the guitar to move up and down in a resonant manner. In the present invention, the motion of the sound board in the lowest mode is more like the motion shown in FIG. 5C, whereas the motion of sound boards of guitars previously known in the art is more like the motion shown in FIG. 5B. The compliant mounting of the perimeter of the sound board in the present invention allows a larger fraction of the area of the sound board to take part in close to the full excursion of the center of the sound board. Thus a small guitar made with the compliantly mounted sound board of the present invention can produce a lowest-mode sound volume similar to a larger guitar made by techniques previously known in the art.

The resonant frequency of the compliant suspension in combination with the mass of the sound board may be designed to be much lower than the resonant frequency of the lowest Chlandi mode shown in FIG. 5, and may be designed to be lower than the Helmholtz resonant mode shown in FIG. 6. As with any couple resonators, if the resonant frequency of the compliantly suspended sound board is placed close to the Helmholtz resonance, the frequencies of the poles due to each will be moved somewhat by the presence of the other resonator. The frequency response of the combined resonators may be designed to be broader and flatter in the center of its pass band than either resonator alone. This added resonant mode allows for a small guitar which is richer sounding and more acoustically like a larger guitar.

In an alternate embodiment, another area of the surface of the guitar (besides the sound board) may be compliantly suspended in addition to or in place of the compliant suspension of the sound board. For instance, all or a portion of the back of the guitar may be compliantly suspended. This in effect creates a second sound board which is designed to couple sound energy to the air primarily in its lowest resonant mode.

DETAILED DESCRIPTION

Figure 1:
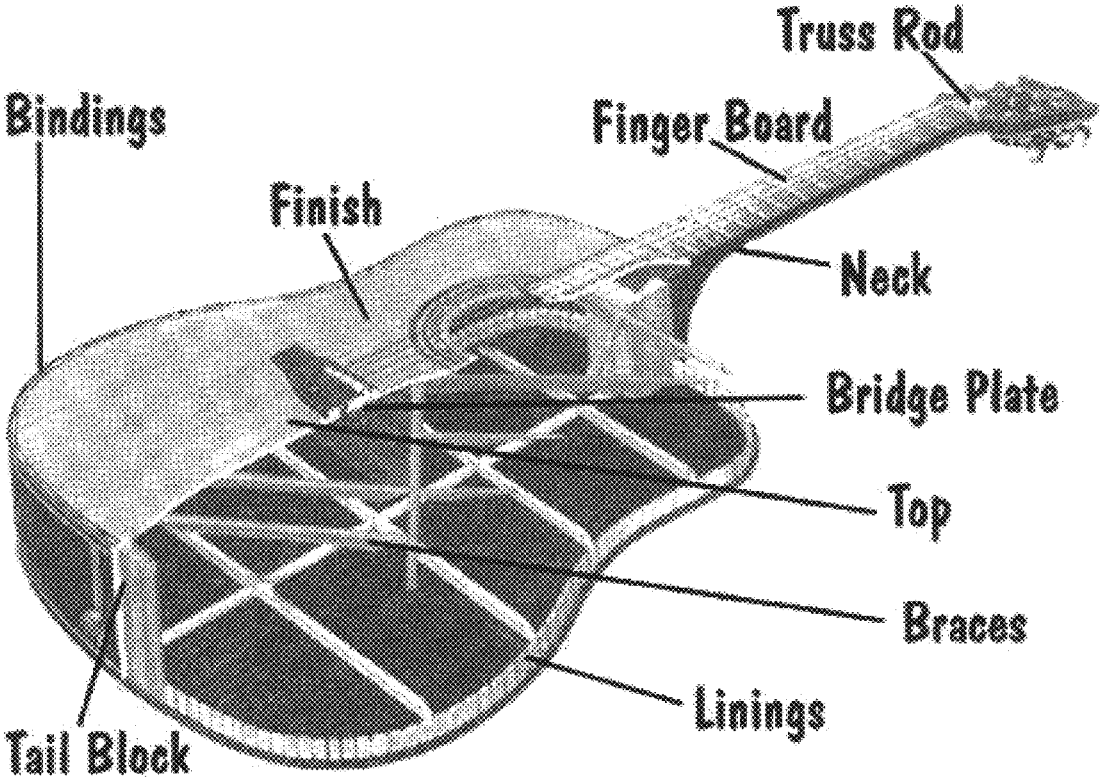
FIG. 1: cutaway drawing of a typical modern acoustic guitar.
Figure 2:
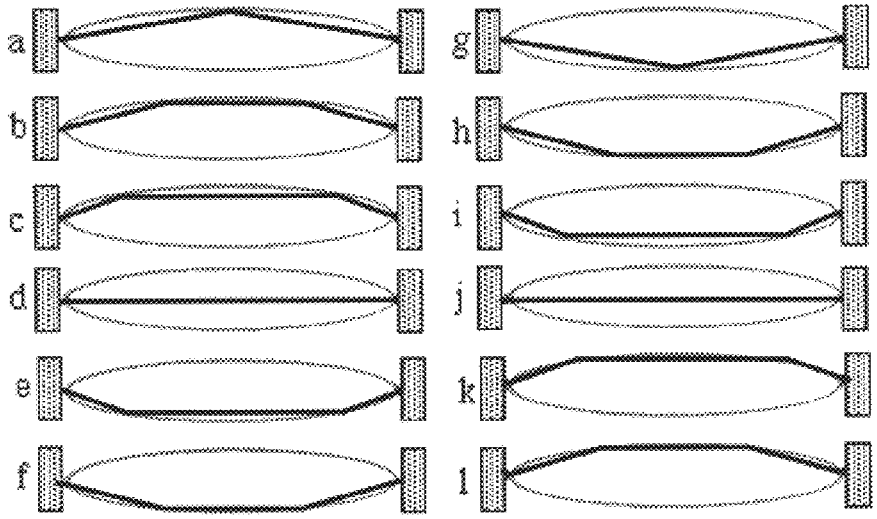
FIG. 2: depiction of sequential 'snapshots' of the oscillation of a string after it is plucked.
Figure 3:
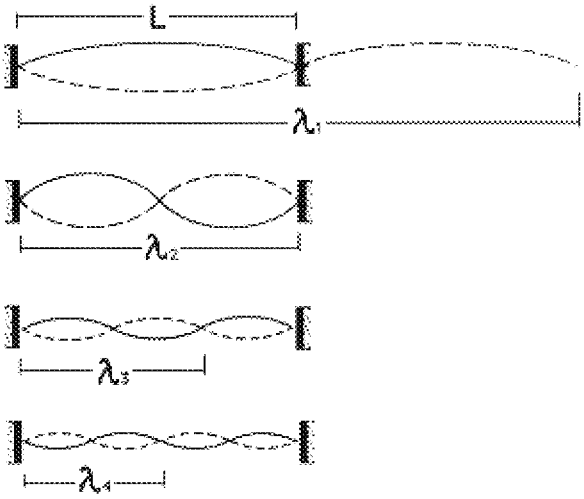
FIG. 3: depiction of different harmonics on a vibrating string.
Figure 4:
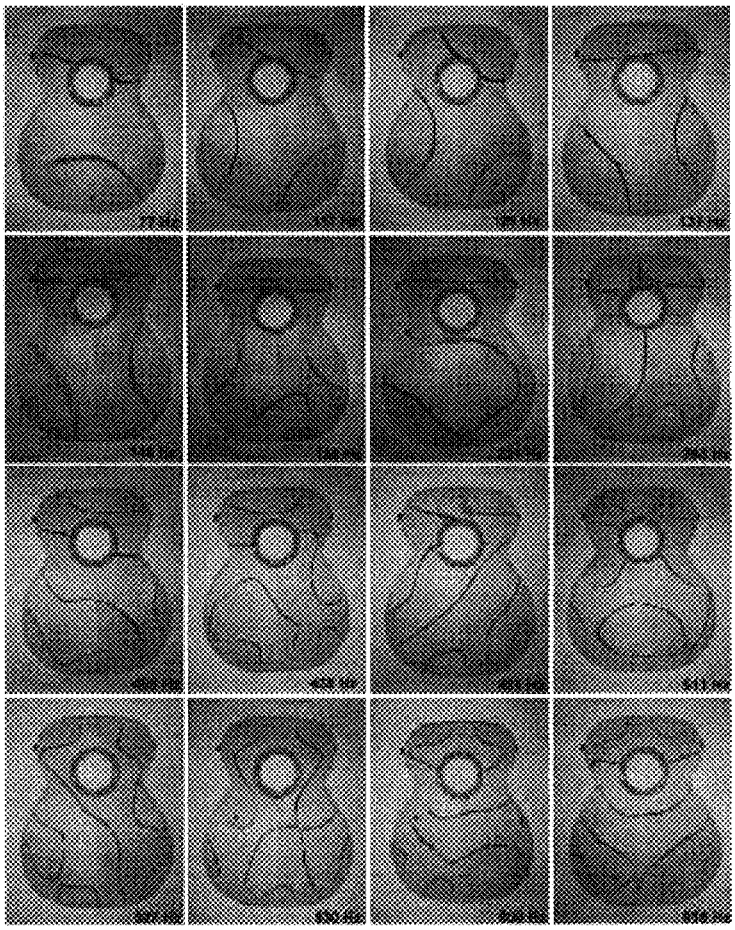
FIG. 4: Chlandi patterns indicating the resonant modes of the top (sound board) of a guitar at various frequencies.
Figure 5A:
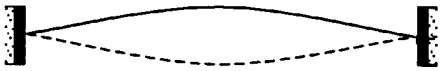
FIG. 5A: depiction of lowest vibrational mode of a sound board of uniform compliance.
Figure 5B:
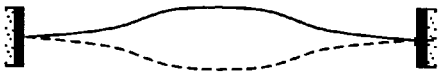
FIG. 5B: depiction of the lowest vibrational mode of a sound board which is rigidly mounted such that the edges are less compliant.
Figure 5C:
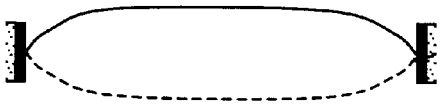
FIG. 5C: depiction of the lowest vibrational mode of a sound board which is compliantly mounted at the edges.
Figure 6:
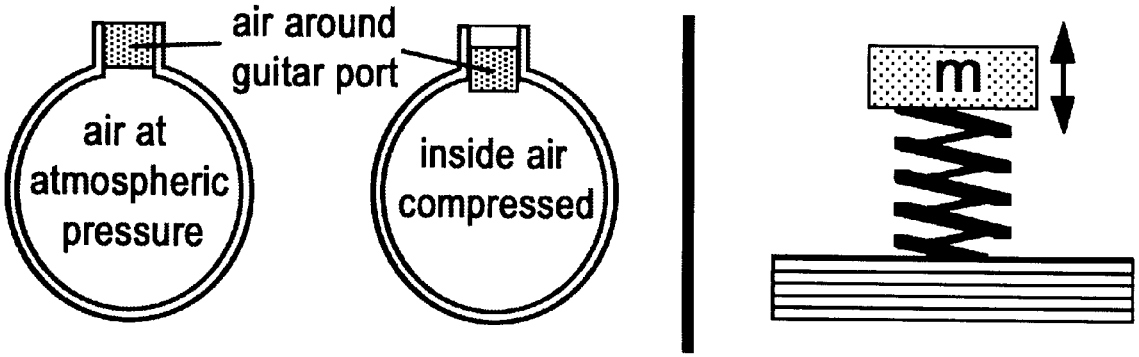
FIG. 6: elements of a Helmholtz resonator.
Figure 7:
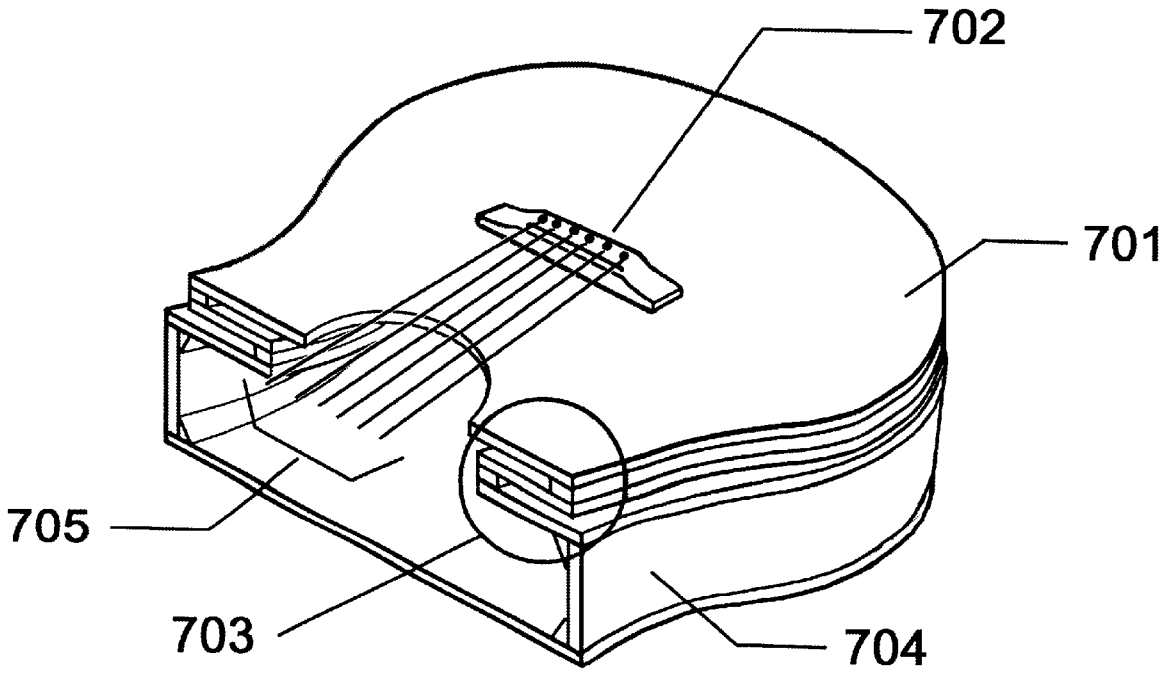
FIG. 7: cut-away diagram of a preferred embodiment of the improved guitar body including sprung suspension of the sound board.

A cut-away diagram of a preferred embodiment of the improved guitar body including sprung suspension is shown in FIG. 7. Vibrational energy from strings 705 of the guitar is transferred to sound board 701 through bridge 702. Spring suspension 703 comprises a wooden bellows-like structure (made of alternating cantilevered circumferential members) connecting the side walls 704 of guitar body 705 to sound board 701. The frequency of the spring-mass resonance set up between the spring compliance of suspension 703 and the mass of sound board 701 is lower than the lowest coupled acoustic resonance typically achievable in a guitar of the same size where the edges of the sound board are non-compliant attached to the side walls. This new low-frequency resonance efficiently couples low-frequency energy from the vibrating strings to the surrounding air, resulting in a deeper, richer sounding guitar than was possible with designs previously known in the art.

In a preferred embodiment, the suspension 703 is more compliant perpendicular to the plane of sound board 701 and less compliant parallel to the plane of sound board 701.

Figure 8:
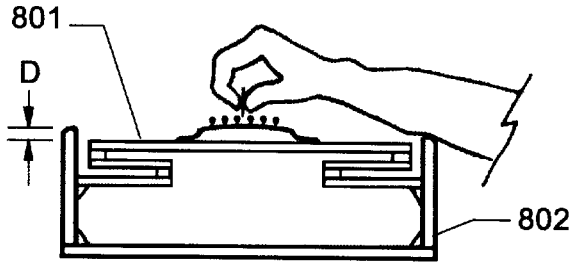
FIG. 8: cross section of a preferred embodiment of the improved guitar body interfacing with a persons arm.

FIG. 8 depicts a preferred embodiment of the present invention where sound board 801 is recessed a distance D into guitar body 802. This recessing of the sound board helps prevent unwanted damping of the lowest resonant mode of the sound board. Such unwanted damping might occur if the arm of the musician playing the guitar were to rest or rub against the compliantly suspended sound board. In guitars previously known in the art, contact of a musician's arm near the edge of the sound board was of little consequence, because the sound board was rigidly mounted at the edge and therefore there was little acoustic vibration near the edge. In the present invention, there is significant acoustic vibration all the way to the edge of the sound board, and a musician resting his or her arm against the edge of the sound board could noticeably alter the tone of the guitar.

A bellows-like suspension such as shown in FIG. 7 is far more compliant perpendicular to the plane of the sound board than it is parallel to the plane of the sound board, thus serving the dual function of suspending the sound board and keeping it accurately centered in the guitar body, so that when the sound board is recessed as shown in FIG. 8, no mechanical rubbing will occur between the outer edges of the sound board and the inner edges of the guitar body.

In alternate embodiments, the sound board suspension may be made out of materials other than wood (such as metal or composite materials, including synthetic composites such as graphite-epoxy).

In alternate embodiments, more than one sound board may be employed. In one alternate embodiment, a suspended sound board is built into the back of the guitar body (the opposite side of the guitar body from the traditional sound board). When more than one sound board is employed, at least one sound board is compliantly suspended. Compliantly suspending more than one sound board adds another resonance and offers additional possibilities for broadening the Helmholtz resonance.

Key Features

- ξ Sprung sound board creates lower frequency coupled acoustic resonance than achievable with non-compliantly attached sound board.
- ξ Edges of sound board still acoustically sealed so porting characteristics of guitar unchanged.
- ξ Sprung sound board can be used to lower and broaden Helmholtz resonance.
- ξ Suspended sound board may be recessed slightly down into side walls so person playing guitar doesn't accidentally constrain sound board and interfere with improved low-frequency resonance by holding guitar.
- ξ Compliance of sound board suspension may be varied around the perimeter of the sound board, in order to intentionally alter some Chlandi patterns more than others.

Definitions

Within this patent application, the term "sound board" shall be construed in one aspect to refer to any substantially planar surface of a stringed musical instrument used to couple vibrational energy from the strings to the surrounding air, and shall be construed in another aspect to refer to any solid surface supported compliantly around its perimeter, allowing limited piston-like travel.

Claims

The foregoing discussion should be understood as illustrative and should not be considered to be limiting in any sense. While this invention has been particularly shown and described with references to preferred embodiments thereof, it will be understood by those skilled in the art that various changes in form and details may be made therein without departing from the spirit and scope of the invention as defined by the claims.

Having described the invention, what is claimed is:

1. An ASISST, comprising:

a. A plurality of strings strung in tension;

b. A sound board compliantly suspended from a rigid surrounding structure by a compliant suspension;

c. Mechanical coupling between said strings and said compliantly suspended sound board.

2. The ASISST of claim 1, wherein said sound board is recessed into said rigid surrounding structure so as to prevent accidental damping of said sound board when said sound board is resonating.

3. The ASISST of claim 1, wherein the compliance of said suspension varies around the perimeter of said sound board.

4. The ASISST of claim 1, wherein said sound board is substantially planar and said suspension is more compliant perpendicular to the plane of said sound board, and less compliant parallel to the plane of said sound board.

5. The ASISST of claim 1, wherein said compliant suspension comprises a wooden bellows structure.

6. The ASISST of claim 5, wherein said bellows structure comprises alternating cantilevered circumferential members.

7. The ASISST of claim 6, wherein the thickness of said alternating cantilevered circumferential members varies around the circumference of said sound board.

8. A guitar comprising a neck, a body, strings, a ported sound board, a bridge, and a compliant suspension, said strings being coupled to said sound board through said bridge, and said compliant suspension attaching circumferentially to said sound board and coupling said sound board compliantly to said body.

9. The guitar of claim 8, wherein said sound board is recessed into said body.

10. The guitar of claim 9, wherein said compliant suspension comprises a wooden bellows structure.

11. The guitar of claim 10, wherein said bellows structure comprises alternating cantilevered circumferential members.

* * * * *